US009927208B2

(12) United States Patent
Petersen et al.

(10) Patent No.: US 9,927,208 B2
(45) Date of Patent: Mar. 27, 2018

(54) MODULAR CARTRIDGE STORAGE SYSTEM FOR FIREARM

(71) Applicant: Magnetospeed, LLC, Austin, TX (US)

(72) Inventors: Weston Petersen, Dripping Springs, TX (US); Alex Sitzman, Austin, TX (US); Garet Itz, Woodland Park, TX (US)

(73) Assignee: Magnetospeed, LLC, Austin, TX (US)

( * ) Notice: Subject to any disclaimer, the term of this patent is extended or adjusted under 35 U.S.C. 154(b) by 0 days.

(21) Appl. No.: 15/236,941

(22) Filed: Aug. 15, 2016

(65) Prior Publication Data

US 2017/0074616 A1 Mar. 16, 2017

Related U.S. Application Data

(60) Provisional application No. 62/204,642, filed on Aug. 13, 2015.

(51) Int. Cl.
*F41C 23/22* (2006.01)
*F41A 23/06* (2006.01)
*F42B 39/02* (2006.01)

(52) U.S. Cl.
CPC ..... *F41C 23/22* (2013.01); *F41A 23/06* (2013.01); *F42B 39/02* (2013.01)

(58) Field of Classification Search
CPC ..... F41C 23/22; F41C 23/16
USPC ..... 42/50, 71.01
See application file for complete search history.

(56) References Cited

U.S. PATENT DOCUMENTS 151,882 A * 6/1874 Jones ..... F41A 9/28 42/59
856,016 A * 6/1907 Balson ..... F41C 23/22 24/506
919,641 A * 4/1909 Rodgers ..... F41C 23/16 42/49.01
931,766 A * 8/1909 Kennedy ..... F41C 23/22 42/71.01
939,709 A * 11/1909 Kephart ..... E05F 11/00 292/305
1,526,847 A * 2/1925 Fritz ..... F41C 23/22 42/71.01
4,597,213 A * 7/1986 Musgrave ..... F41C 27/00 42/90
4,799,323 A * 1/1989 Musgrave ..... F41A 17/38 42/90

(Continued)

*Primary Examiner* — Joshua E Freeman
(74) *Attorney, Agent, or Firm* — Hunt Pennington Kumar & Dula, pllc; Jeffrey D. Hunt

(57) ABSTRACT

This disclosure relates to a system and method for storage of a modular cartridge within a cavity formed in a portion of a firearm, wherein the cavity is not the magazine well of the firearm. The disclosure provides for a system for disengagebly retaining such modular cartridges, as well as multiple embodiments of cartridges which may be retained therein. Such embodiments of modular cartridges include: a miniature magazine (mini-mag) which may be used to store ammunition, and which may be operable as a magazine for the firearm; a dry box which may be used to store materials in a manner in which they are protected from the ambient environment; a monopod which may be used to help support a firearm; a flashlight; and a battery charger, which may provide for a usb output.

5 Claims, 14 Drawing Sheets

(56) References Cited

U.S. PATENT DOCUMENTS

| | | | | | |
|---|---|---|---|---|---|
| 5,159,136 | A * | 10/1992 | Marsh | F41C 23/22 | 42/71.01 |
| 5,225,613 | A * | 7/1993 | Claridge | F41C 23/22 | 42/74 |
| 6,536,152 | B1 * | 3/2003 | Wisz | F41C 23/22 | 42/1.02 |
| 6,981,344 | B2 * | 1/2006 | Cahill | F41C 23/10 | 42/71.01 |
| 8,887,972 | B2 * | 11/2014 | Solomon | A45F 5/02 | 224/245 |
| 2003/0136044 | A1 * | 7/2003 | Williams | F41A 29/00 | 42/95 |
| 2006/0185214 | A1 * | 8/2006 | Long | F41A 23/06 | 42/71.02 |
| 2006/0196068 | A1 * | 9/2006 | Thompson | E04G 21/1891 | 33/613 |
| 2007/0039989 | A1 * | 2/2007 | Nistico | A45F 5/02 | 224/674 |
| 2010/0139144 | A1 * | 6/2010 | Fitzpatrick | F41A 11/02 | 42/73 |
| 2013/0098935 | A1 * | 4/2013 | Sheffield | F41A 9/64 | 221/1 |
| 2016/0025436 | A1 * | 1/2016 | Higley | F41A 9/70 | 42/49.01 |

* cited by examiner

MODULAR CARTRIDGE STORAGE SYSTEM FOR FIREARM

CROSS-REFERENCE TO RELATED APPLICATIONS

This application is related to, and claims priority to, U.S. Provisional Patent Application No. 62/204,642 filed Jul. 13, 2015, which is hereby incorporated by reference in its entirety.

FIELD OF THE INVENTION

The subject matter disclosed herein relates to firearms, and specifically to systems and methods for providing and storing modular firearm accessories within the structure of a firearm.

BACKGROUND

Firearms, firearm systems, firearm platforms, firearm structures, modular firearm components and structures, firearm accessories, modular firearm accessories, and methods for providing and storing modular firearm accessories within the structure of a firearm, firearm system or firearm platform are limited in utility, interchangeability, reliability, durability, features, and costliness.

BRIEF DESCRIPTION

The purpose of this summary is to present integral concepts in a simplified form as a prelude to the more detailed disclosure that is presented herein.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

This disclosure relates to systems and methods for a modular cartridge retaining system ("modular cartridge retaining system" and "modular cartridge system" may be used herein interchangeably) that may be retained within a portion of a firearm. The modular cartridge system provides for a plurality of modular cartridges, each modular cartridge having different functionality. The modular cartridges, when engaged, may be retained inside of a recessed portion of the firearm, specifically a recessed portion that is different from the firearm's firing chamber. The modular cartridges may be disengageable from the recessed portion of the firearm upon actuation of an engagement/disengagement mechanism. The disclosure also relates to firearms and firearm systems including such modular cartridge retaining systems. The disclosure also relates to methods for firearms and firearm systems including modular cartridge systems as disclosed.

Descriptions of certain illustrative aspects are described herein in connection with the annexed Figures. These aspects are indicative of various non-limiting ways in which the disclosed subject matter may be utilized, all of which are intended to be within the scope of the disclosed subject matter. Other advantages, emerging properties, and features will become apparent from the following detailed disclosure when considered in conjunction with the associated Figures that are also within the scope of the disclosure.

BRIEF DESCRIPTION OF THE DRAWINGS

The disclosed subject matter itself, as well as further objectives, and advantages thereof, will best be illustrated by reference to the following detailed description of embodiments of the device read in conjunction with the accompanying Figures, wherein.

DETAILED DESCRIPTION

Figure 1:
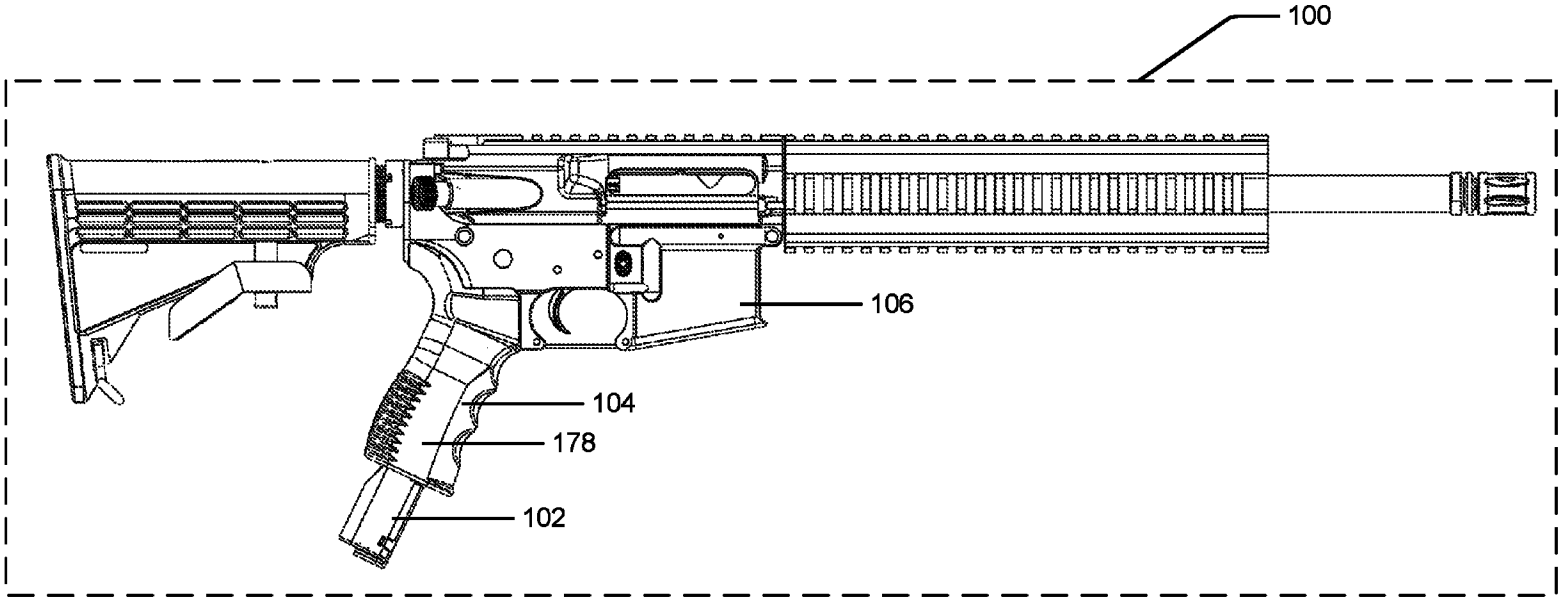
FIG. 1 depicts a firearm system having a modular cartridge extending out of a pistol grip.

Reference now should be made to the Figures in which the same reference numbers are used throughout the multiple Figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the figures to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

While the descriptions of embodiments contained herein may refer to particular firearm 100 types (such as the AR-15 platform as depicted in FIG. 1) any such description is to be for the purposes of providing an exemplar of particular embodiments of the invention, and is not intended to limit the scope of the teachings included herein in any way. As used herein, in embodiments, "firearm" may include any firearm system, firearm platform or firearm structure having a magazine well 106 external of the grip portion 178, such as a pistol grip, of the firearm.

One having skill in the art will be aware that some firearms (mainly pistols) have a system for retaining a magazine within their grip. For such firearms the magazine well (the portion of the firearm that retains the magazine while ammunition from the magazine is fed into the firing system of the firearm) is located in the grip itself. Such a configuration wherein the magazine well is located in the grip is different from that being taught herein, Referring to FIG. 1, the teachings of the present disclosure are directed to a firearm 100 including a magazine well 106 external of a pistol grip or other grip portion 178 of the firearm 100. As shown, in embodiments, firearm 100 may include a cavity 114 and its associated interior volume 114, modular cartridge retaining system 104, and cartridge 102 located and incorporated into a portion of a firearm 100 other than a magazine well 106. According to the present disclosure and as also more particularly shown in FIG. 1, in some embodiments a firearm 100 may include a cavity 114 and its associated interior volume 114, modular cartridge system 104, and cartridge 102 located and incorporated into a grip portion 178 of the firearm 100, whether integral or detachable, which do not comprise the magazine well 106.

Figure 2A:
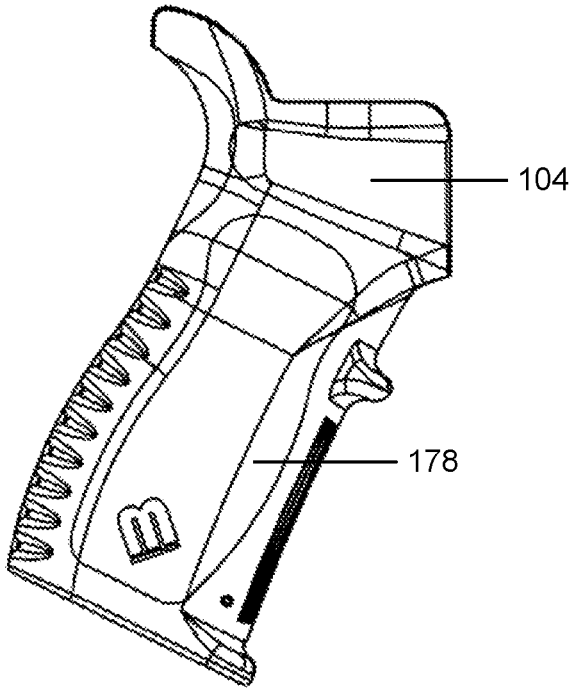
FIG. 2A depicts a side view of a pistol grip in which a modular cartridge retaining system may be located.
Figure 2B:
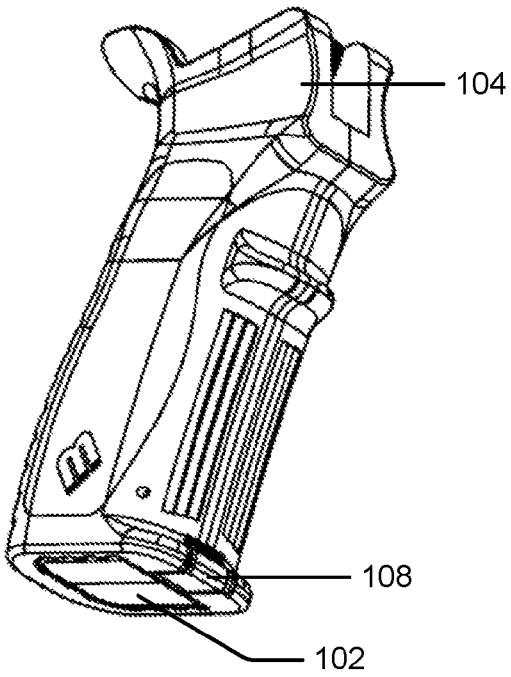
FIG. 2B depicts a perspective view of the pistol grip of FIG. 2A where in the bottom a modular cartridge may be seen through an opening in the bottom of the pistol grip.

While depicted in a pistol grip throughout the associated figures it should be understood that embodiments of the modular cartridge retaining system 104 may be built into, or included in, any grip portion 178 of a firearm 100, including a fore-grip, stock, pistol grip as seen in FIGS. 2A and B, or butt, (collectively, "grip portion" 178). In some embodiments (not shown), a modular cartridge retaining system 104 may be built into, or included in, any other structural portion of a firearm 100 that may provide for a suitable cavity without departing from the scope of this disclosure.

Figure 6:
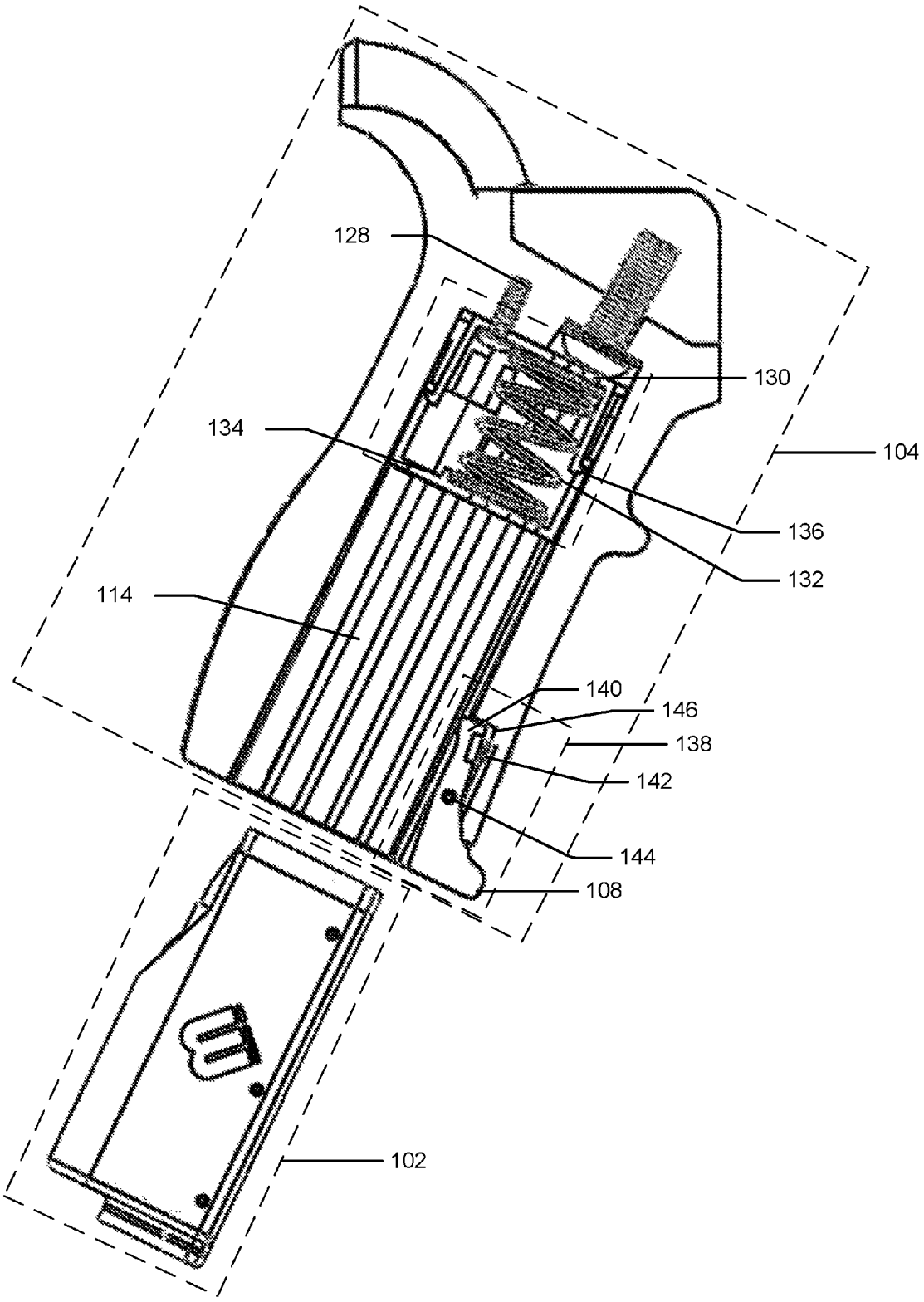
FIG. 6 depicts a partial cross-sectional view of a modular cartridge retaining system inside of a pistol grip, the modular cartridge retaining system having the modular cartridge ejected therefrom.
Figure 7A:
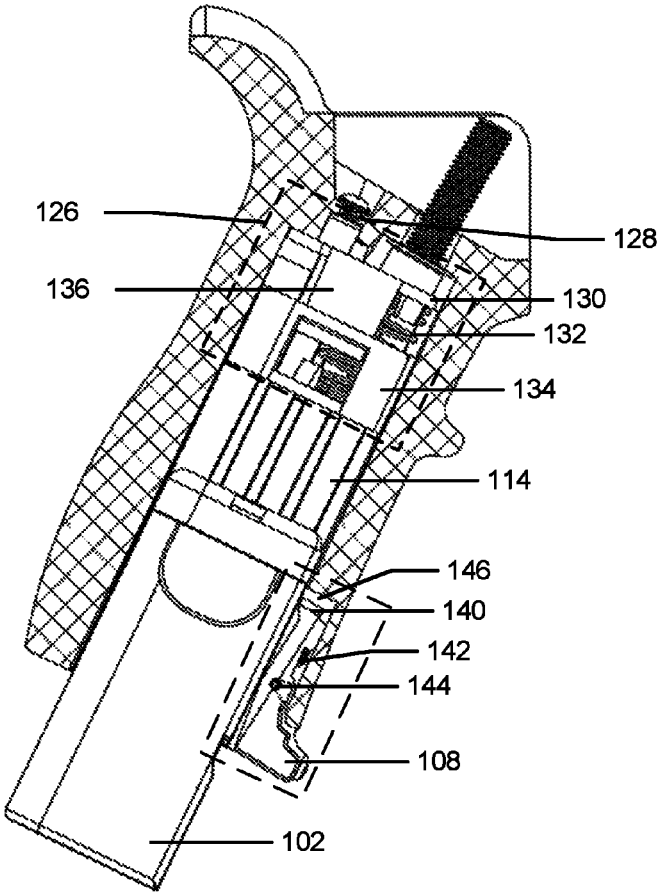
FIG. 7A depicts a partial cross-sectional view of a modular cartridge retaining system inside of a pistol grip, the modular cartridge retaining system having a cartridge partially inserted therein.
Figure 7B:
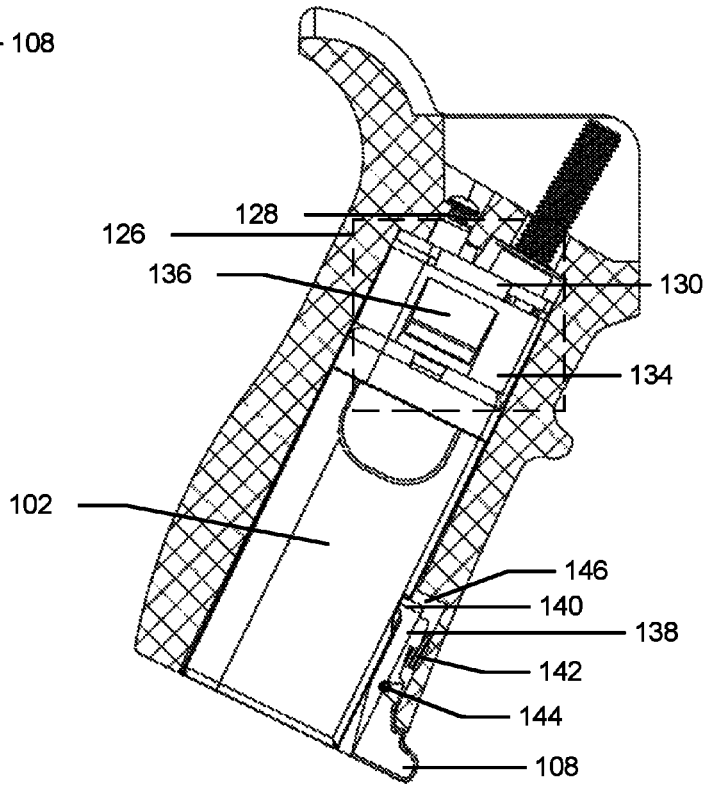
FIG. 7B depicts a partial cross-sectional view of a modular cartridge retaining system inside of a pistol grip, the modular cartridge retaining system having a cartridge fully retained therein.
Figure 8:
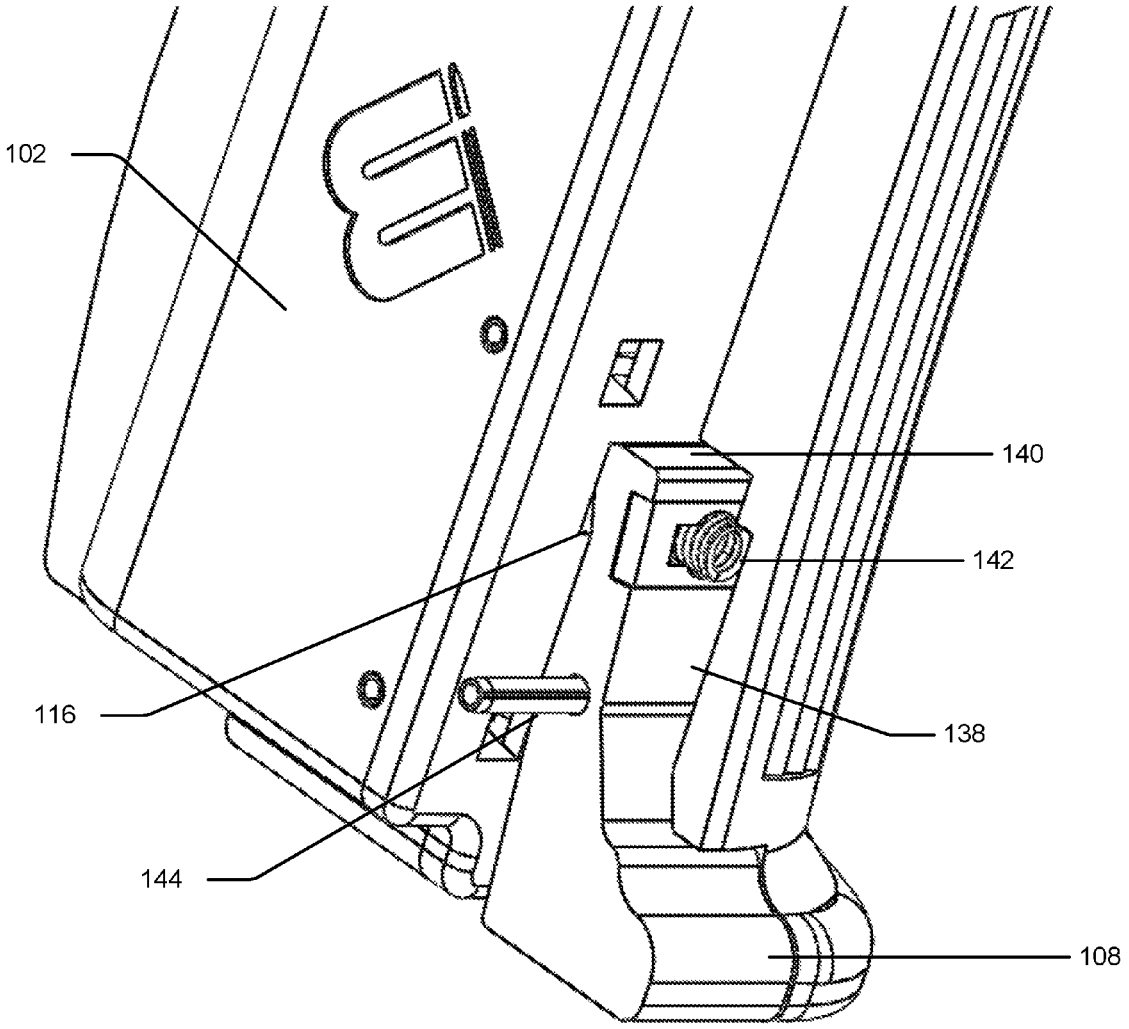
FIG. 8 depicts an enlarged view of the biasing lever portion of a cross-sectional view of a modular cartridge retaining system wherein a cartridge is retained therein via engagement with the biasing lever.
Figure 9A:
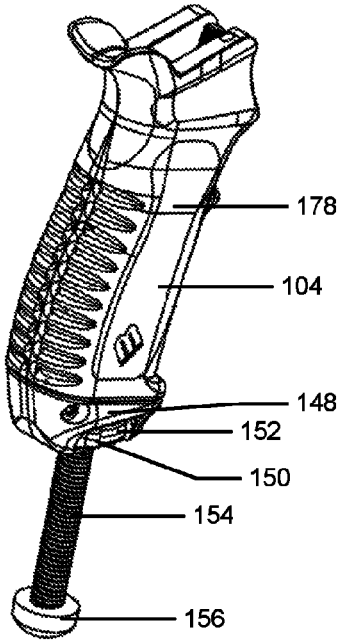
FIGS. 9A-D depict different perspective views of a monopod embodiment of a cartridge fully retained inside of a modular cartridge retaining system, wherein the extending portion of the monopod is extended.
Figure 9B:
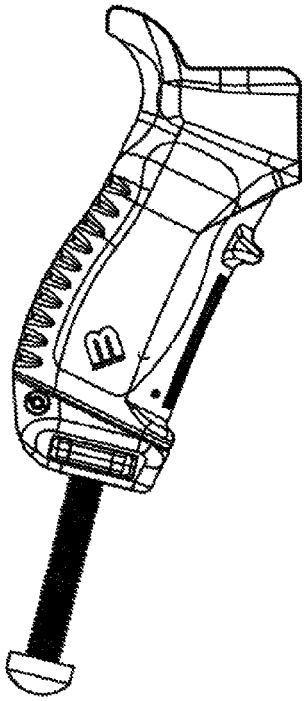
Figure 9C:
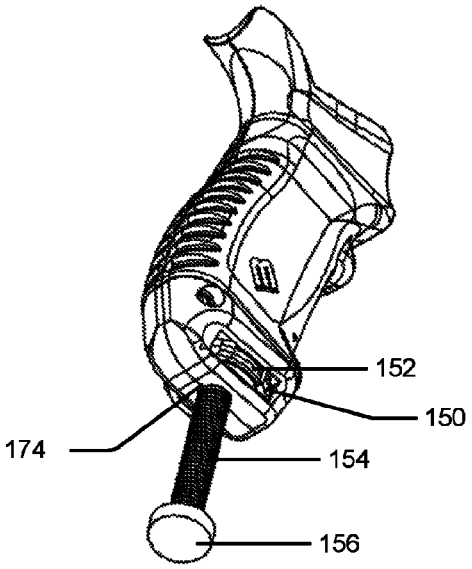
Figure 9D:
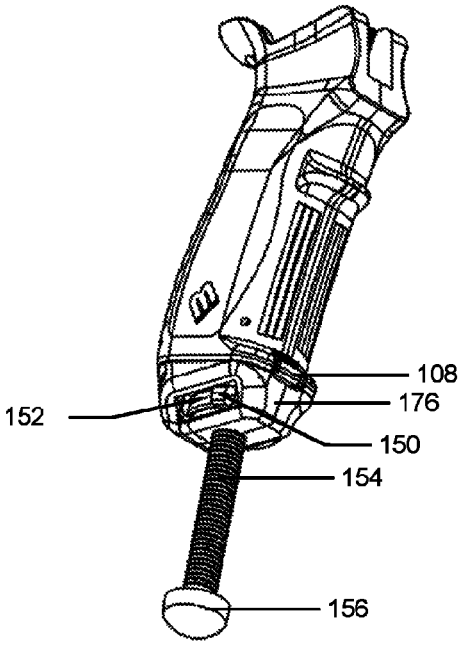
Figure 10A:
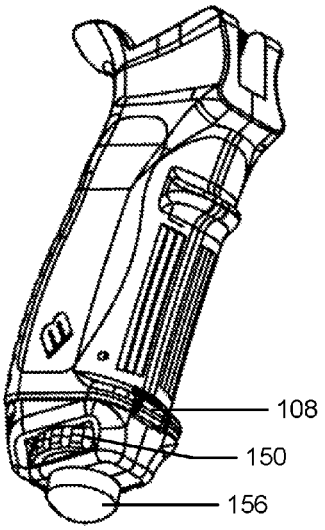
FIGS. 10A-D depict a modular cartridge system having a monopod embodiment of a cartridge associated therewith, wherein the cartridge at different levels of insertion into the modular cartridge retaining system, and wherein the extending portion is at different levels of extension.
Figure 10B:
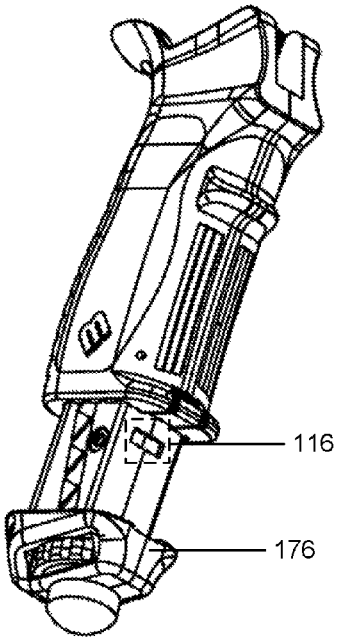
Figure 10C:
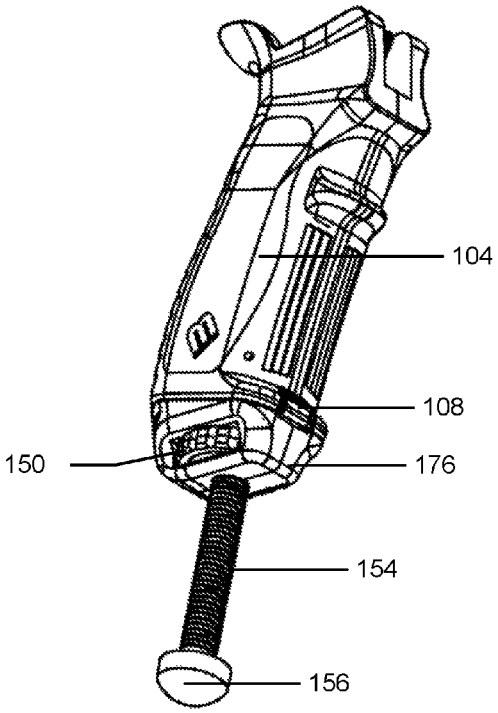
Figure 10D:
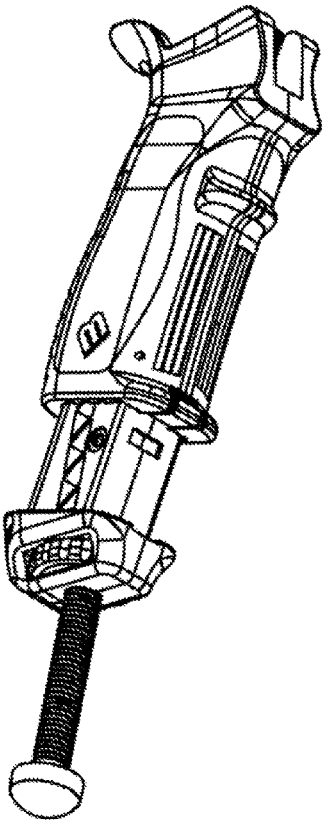
Figure 11A:
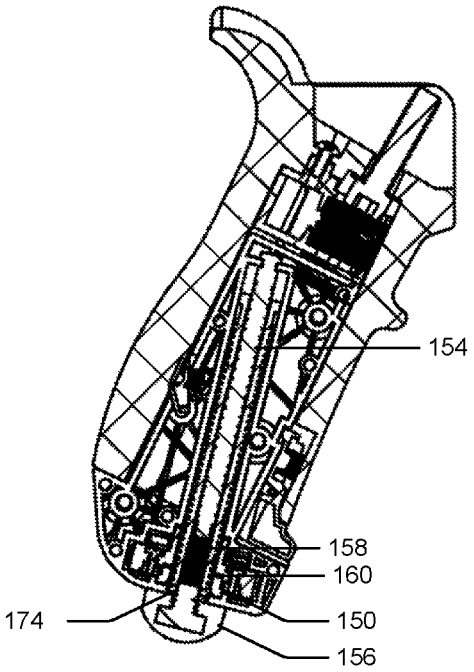
FIGS. 11A-D depict partial cross-sectional views of FIGS. 10A-D.
Figure 11B:
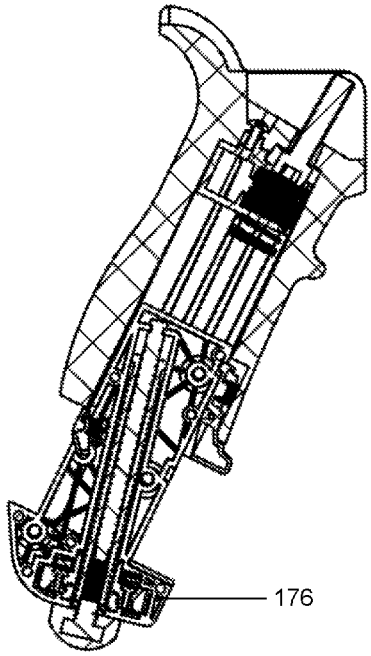
Figure 11C:
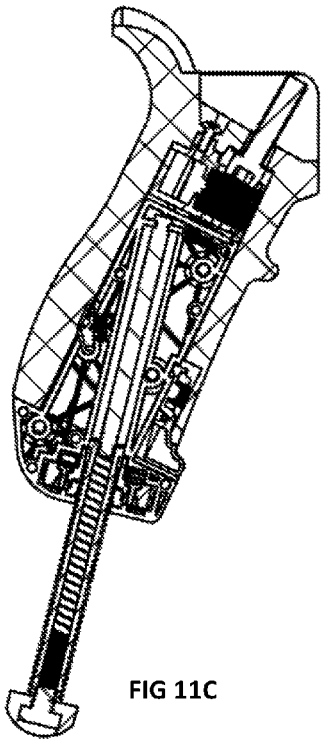
Figure 11D:
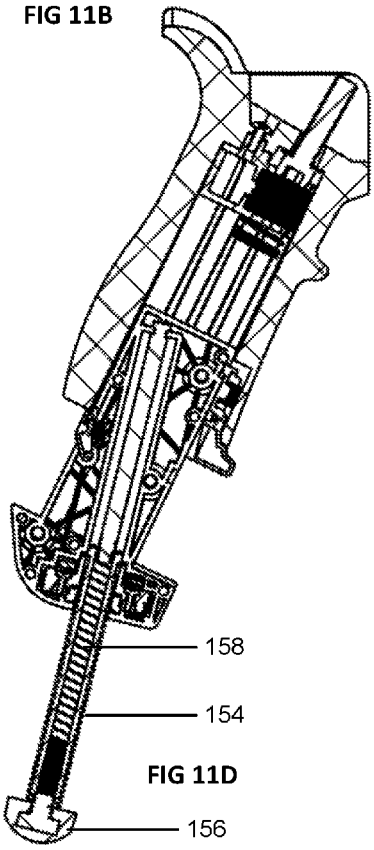

With reference to FIGS. 6 and 7A and B, embodiments of the modular cartridge retaining system 104 may comprise a cavity 114 comprising a top surface, a plurality of lateral surfaces, and an opening, the cavity 114 defining an interior volume 114. At least one of the plurality of lateral surfaces of the cavity 114 may have a recessed portion 146. A biasing lever 138 may have an engaging end 140 on one side and a release 108 on the other. The biasing lever 138 may be predominantly retained within the recessed portion 146 of one of the plurality of lateral surfaces of the cavity 114. The biasing lever 138 may be pivotable about a pivot 144 from a default engaged position to a disengaged position. The biasing lever 138 may be maintained in the default position via application of force on the engaging end 140 of the biasing lever 138 by a biasing spring 142, or by any other mechanism suitable for urging or biasing the engaging end 140 to the default position. In the particular embodiment shown in FIGS. 7B and 8, while in the default position the engaging end 140 of the biasing lever 138 extends out of the recessed portion 146 of the lateral surface of the cavity 114 into the interior volume 114. Actuation of the release 108 causes the pivoting of the biasing lever 138 about the pivot 144, thereby compressing the biasing spring 142 and transitioning the biasing lever 138 from the default engaged position to the disengaged position (see FIG. 7A). In the disengaged position the engaging end 140 of the biasing lever 138 is seated within the recessed portion 146 of the lateral surface. It will be understood that the biasing lever 138 may be transitioned to the disengaged position by functioning of any suitable mechanism.

Further referencing FIGS. 7A and B, embodiments of the modular cartridge retaining system 104 may comprise an ejection mechanism 126. The ejection mechanism 126 may comprise an anchor plate 130, an ejection sled 134, one or more ejection sled connectors 136, and an ejection spring 132. The anchor plate 130 may have a top surface which may abut and be secured to the top surface of the cavity 114 via an anchor screw 128. The bottom surface of the anchor plate 130 may mechanically engage a first end of the ejection spring 132. The second end of the ejection spring 132 may mechanically engage a top surface of the ejection sled 134. The one or more ejection sled connectors 136 may be configured to connect the anchor plate 130 to the ejection sled 134 in such a manner as to allow for travel of the ejection sled 134 relative to the anchor plate 130 relative to a longitudinal axis of the cavity 114 due to a force imparted by the ejection spring 132. The transition of the ejection sled 134 may be from a first position in which the ejection spring 132 is less compressed to a second position in which the ejection spring 132 is more compressed. A bottom surface of the ejection sled 134 may abut a top surface of a cartridge 102 when the cartridge 102 is retained within the cavity 114. The force resultant from the compression of the ejection spring 132 may hold a stop 118 portion of a depression 116 of the cartridge 102 in mechanical contact with the engaging end 140 of the biasing lever 138 while the biasing lever 138 is in the default engaged position. The same force resultant from the compression of the ejection spring 132 may also provide a force which may be used to eject the cartridge 102 from the interior volume 114 of the cavity 114 when the release 108 is actuated and the engaging end 140 of the biasing lever 138 is disengaged from mechanical contact with the stop 118 portion of the depression 116 of the cartridge 102.

A multitude of embodiments of cartridges 102 which may be used with the modular cartridge retaining system 104 are described herein. The different embodiments of the cartridge 102 may provide for different utility. Several of these different embodiments of the cartridge 102 usable with cartridge retaining system. Each of the cartridges 102 may comprise the features required for use with and integration into the modular cartridge retaining system 104, as well as other features which may vary among embodiments in order to provide for the differing utility associated therewith.

Embodiments of the cartridge, as can be seen in all FIGs associated herewith, 102 may comprise a depression 116 in one of the lateral surfaces of the cartridge 102. The depression 116 may comprise a bevel 122, a floor 120, and a stop 118. The depression 116 may be configured such that when the cartridge 102 is retained within the interior volume 114 of the cavity 114 the depression 116 lines up with the engaging end 140 of the biasing lever 138. The stop 118 may interface with the engaging end 140 of the biasing lever 138 while the biasing lever 138 is in the default engaged position (see FIGS. 7B and 8) so as to prevent the ejection of the cartridge 102 from within the interior volume 114. As the release 108 is actuated and the biasing lever 138 transitions from the default engaged position to the disengaged position the engaging end 140 of the biasing lever 138 recedes from the depression 116 into the recessed portion 146 of the lateral surface of the cavity 114 and thus disengages from mechanical interaction with the stop 118 portion of the depression 116 of cartridge 102, thereby allowing for the cartridge 102 to be ejected from the interior volume 114 of the cavity 114.

Embodiments of a cartridge 102 may be shaped and sized to be insertable into the interior volume 114 of the cavity 114.

Embodiments of a cartridge 102 may comprise a stop 118 whose surface is at a 90 degree or smaller angle relative to the lateral surface of the cartridge 102. Such an angle may assist with the mechanical interaction between the stop 118 and the engaging end 140 of the biasing lever 138 when the cartridge 102 is retained inside of the interior volume 114 of the cavity 114. A smaller angle may allow for slippage or other unintentional disengagement of the engaging end 140 of the biasing lever 138 without actuation of the release 108.

Now referencing FIGS. 9A-D, 10A-D, and 11A-D, embodiments of a monopod 148 embodiment of the cartridge 102 may comprise an extending portion 154, an aperture 174 in the bottom surface of the cartridge 102 through which the extending portion 154 may extend, an extending spring 158 positioned between the top surface of the cartridge 102 and the extending portion 154 and configured to impart a force on the extending portion 154 in the direction of the aperture 174, a thumbwheel 150 having a tooth 160, and a quick release 152. The thumbwheel 150 may mechanically engage the extending portion 154 via the tooth 160 in such a manner as to facilitate extension and retraction of the extending portion 154 responsive to the rotation of the thumbwheel 150. The mechanical engagement between the tooth 160 and the extending portion 154 may prevent the extension or retraction of the extending portion 154 except for when the thumbwheel 150 is rotated. The quick release 152 may allow for disengagement of the tooth 160 from the extending portion 154, thereby allowing for rapid extension of the extending portion 154 responsive to the force imparted thereto by the extending spring 158, or allowing for rapid retraction of the extending portion 154 responsive to a force opposite the force provided by the extending spring 158 imparted thereto by an object external to the monopod cartridge 148 (e.g. a person's hand or other solid surface).

In embodiments, the monopod 148 embodiment of the cartridge 102 may comprise a bottom portion 176 that extends below the opening of the cavity 114. Such a bottom portion 176 extending below the opening of the cavity 114 may comprise the thumbwheel 150 and the quick release 152 so as to provide the operator manual access thereto.

In embodiments, the extending portion 154 may be threaded, and the tooth 160 may engage and traverse the threading of the extending portion 154 so as to facilitate extension/retraction of the extending portion 154 responsive to rotation of the thumbwheel 150, and so as to prevent extension/retraction of the extending portion 154 when the thumbwheel 150 is not being rotated.

In embodiments, the quick release 152 may be integrated into a portion of the thumbwheel 150, and may allow for disengagement of the tooth 160 through depression of the quick release 152 portion of the thumbwheel 150.

The quick release 152 is designed to provide for rapid extension and retraction of the extending portion 154 to a general desired length, while rotation of the thumbwheel 150 is designed for allowing an operator to make fine adjustments to the length of the extension of the extending portion 154.

In embodiments there may be a foot 156 attached to the distal end of the extending portion 154. The foot 156 may made of materials or textured to prevent slippage of the foot 156 when resting on a surface.

Figure 12A:
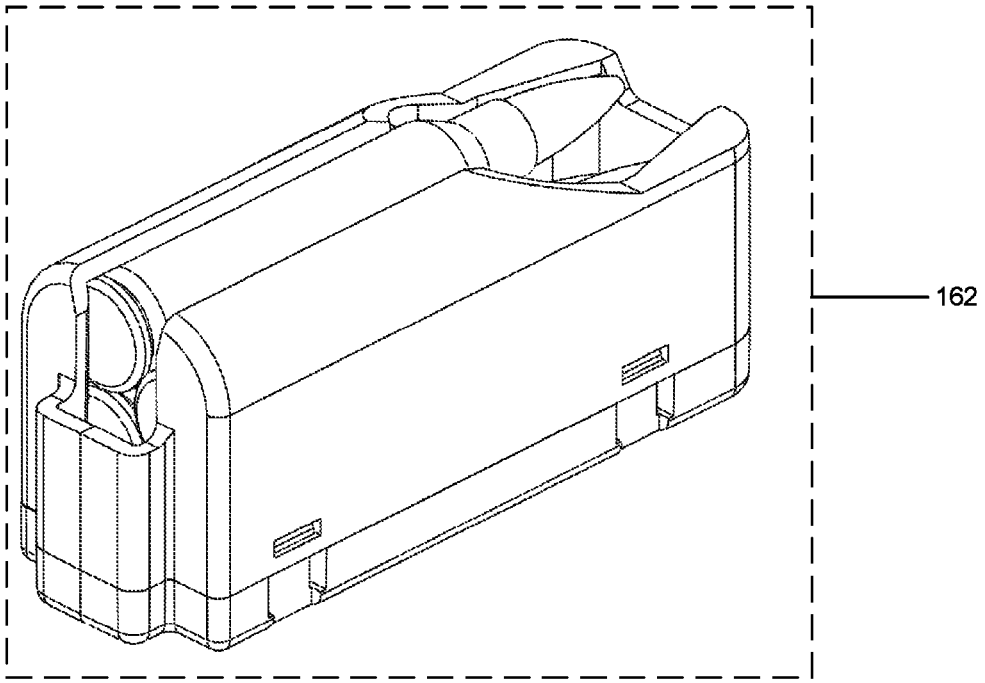
FIGS. 12A and B depict different perspective views of a mini-mag embodiment of a cartridge.
Figure 12B:
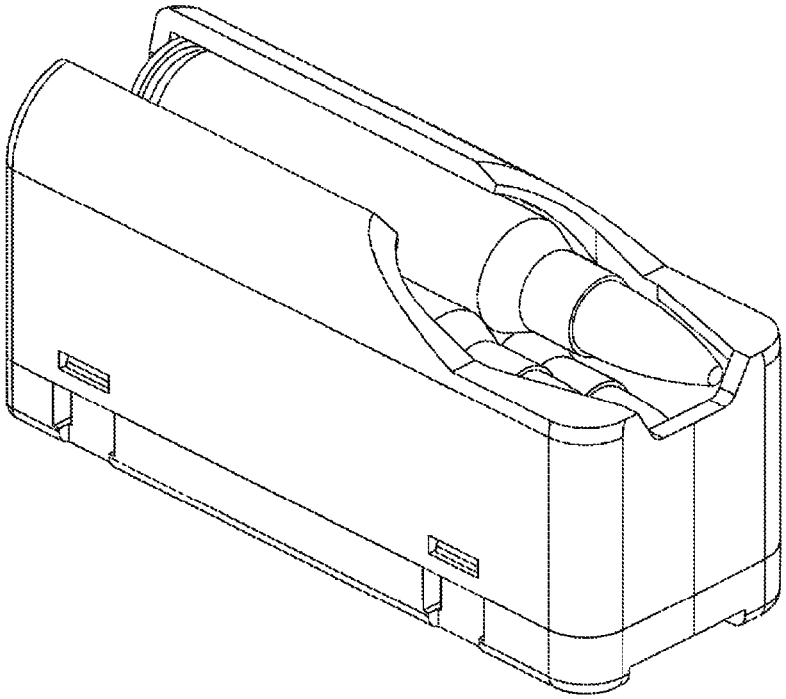
Figure 13A:
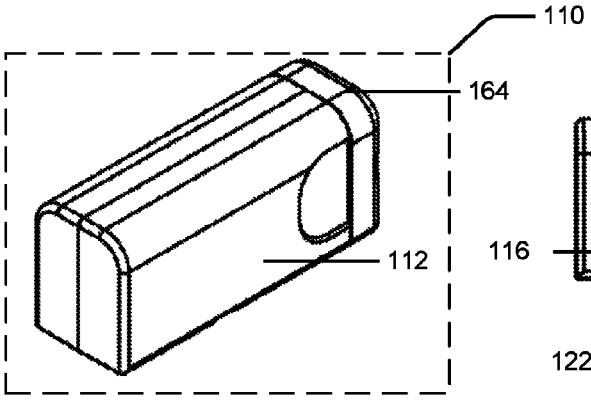
FIGS. 13A-F depict different perspective views of a dry box embodiment of a cartridge (FIGS. 13E and F show the lid removed from the body of the dry box embodiment of a cartridge).
Figure 13B:
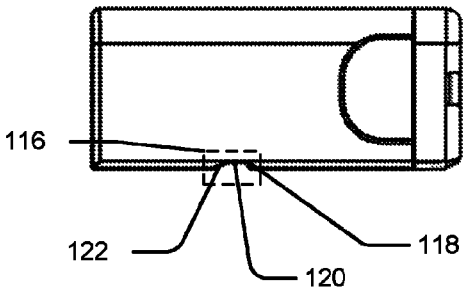
Figure 13C:
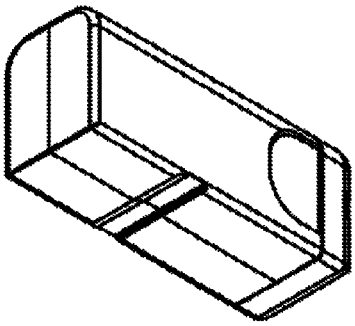
Figure 13D:
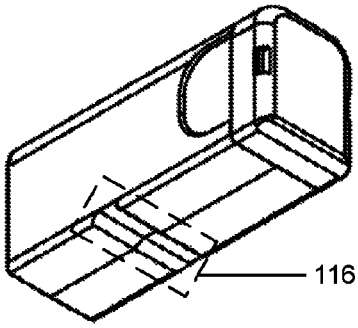
Figure 13E:
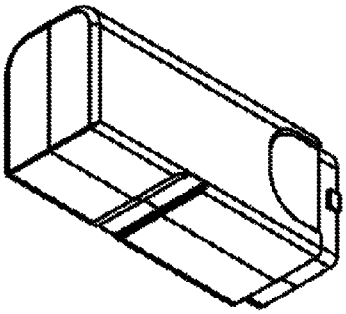
Figure 13F:
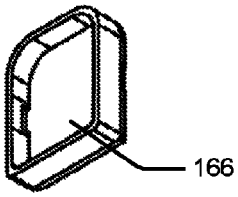
Figure 13F:
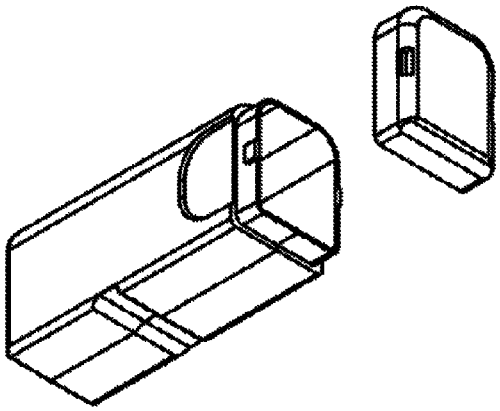
Figure 14A:
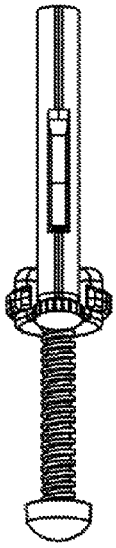
FIG. 14A-I depict different perspective views of an alternate embodiment of a monopod embodiment of a cartridge (one made for use with a cavity not having a modular cartridge retaining system therein), wherein the extending portion is extended.
Figure 14B:
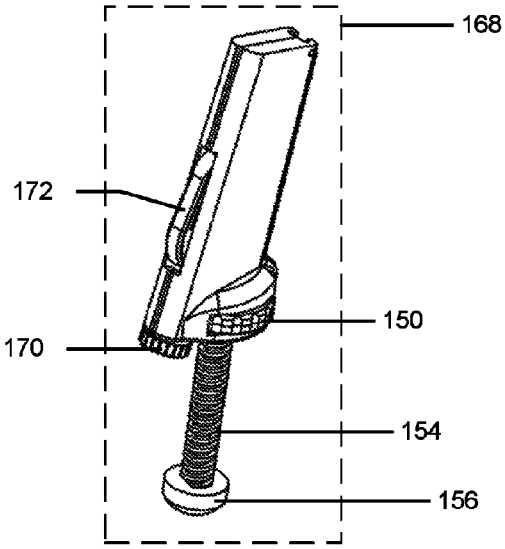
Figure 14C:
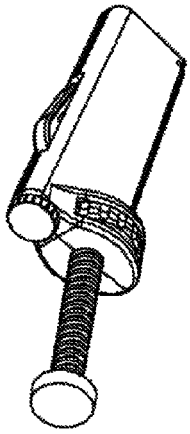
Figure 14D:
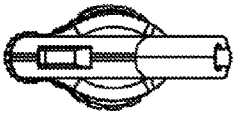
Figure 14E:
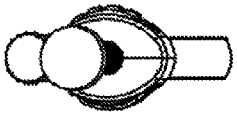
Figure 14F:
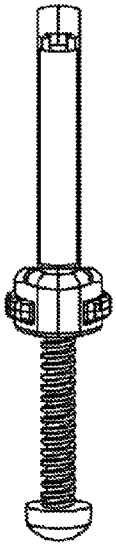
Figure 14G:
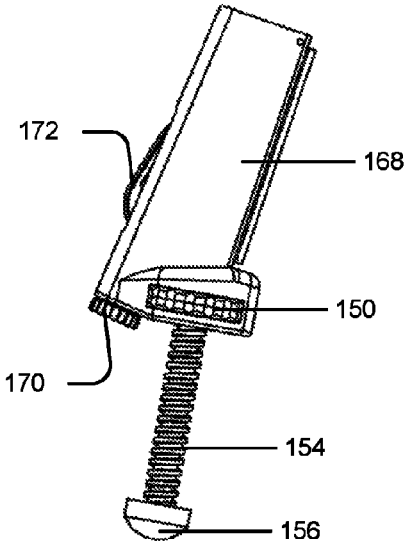
Figure 14H:
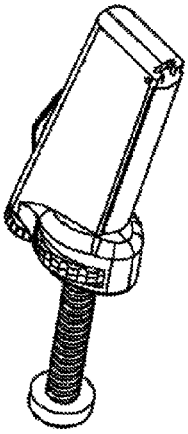
Figure 14I:
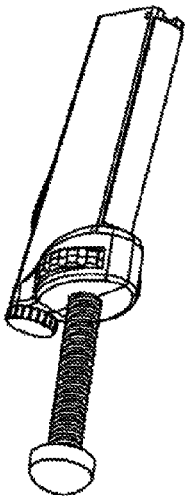

FIGS. 12A and B depict a mini-mag embodiment 162 of the cartridge 102. It is important to note, and one having skill in the art will understand, that for the mini-mag cartridge embodiment 162 comprising a firearm magazine it is essential for the mini-mag cartridge 162, once removed from the recessed volume 114, to be operably compatible with the firing system of the firearm 100 so as to operate as a functional magazine. Such mini-mag embodiments 162 of the cartridge 102 should therefore be configured to retain and allow for functional use of the type of ammunition that the firearm 100 uses. Therefore, different embodiments of the mini-mag embodiment 162 of the cartridge 102 may be configured for different ammunition types. Those having skill in the art will recognize that there are a multitude of different ammunition calibers and designs, none of which are intended to be excluded from the teachings of this disclosure.

In embodiments, the mini-mag embodiment 162 of the cartridge 012 may or may not be configured to function with the firearm 100 that comprises the modular cartridge retaining system 104 (it may provide a magazine for a sidearm, or another firearm platform).

In embodiments, the mini-mag embodiment 162 of the cartridge 012 may be retained within the modular cartridge retaining system 104 in a first orientation and may have to be removed from the cavity 114 and rotated to a second orientation in order to be operably inserted into the magazine well 106 of the firearm 100.

One skilled in the relevant art will understand the manner in which a firearm magazine operates and may understand how the teachings included herein may be applied to enable a modular cartridge 102 as described and shown to be used as a detachable magazine capable of operable use with the magazine well 106 of a firearm 100 when in the correct orientation.

Figure 3A:
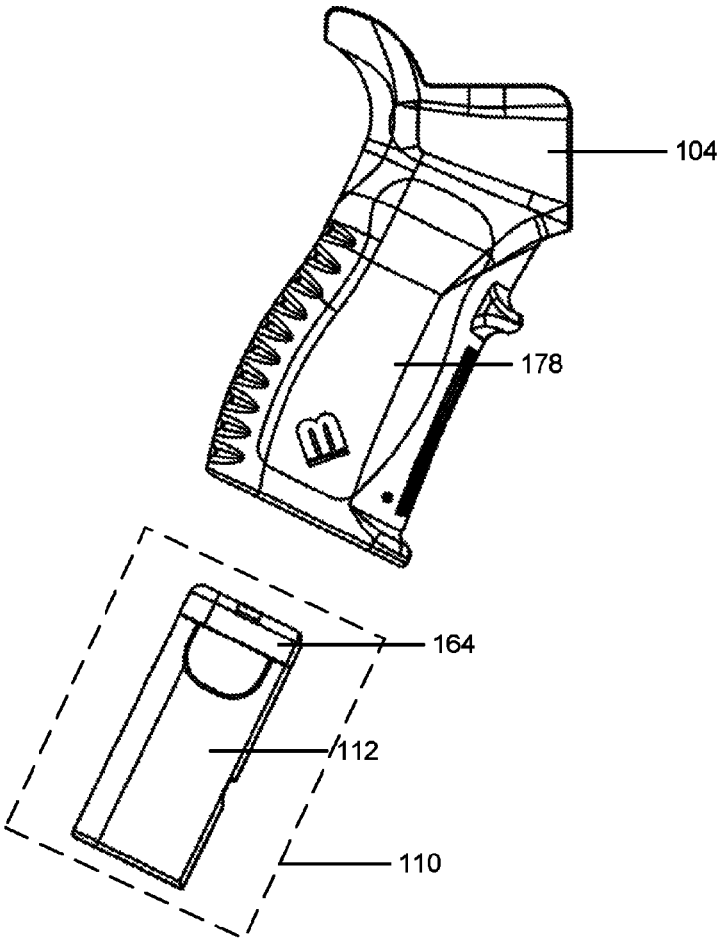
FIGS. 3A and 3B depict the same views of as FIGS. 2A and 2B wherein the modular cartridge has been removed from the interior volume of the cavity in the pistol grip. The modular cartridge depicted is a dry box embodiment.
Figure 3B:
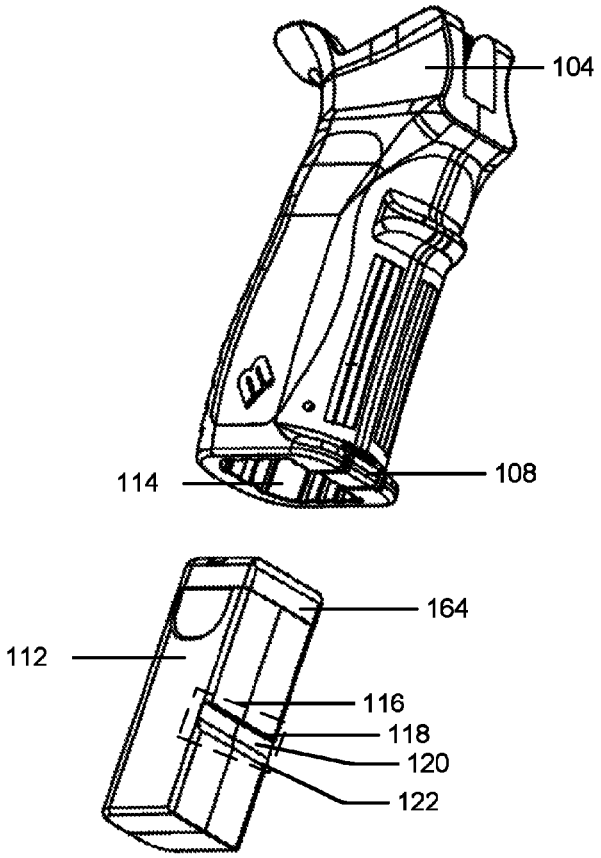

As depicted in FIGS. 3A and B, 7A and B, and 13A-F, embodiments of the cartridge 102 may provide for a dry box cartridge 110. A dry box cartridge 110 is a storage container designed to keep the interior at a low level of humidity. Dry boxes are used to safely store items that would otherwise be damaged or adversely affected by excessive humidity. The dry box embodiment 110 of the cartridge 102 may be an airtight or watertight enclosure. The airtight/watertight capability of the dry box cartridge 110 may be provided via the use of a deformable gasket 166 provided between a lid 164 and a body 112 of the dry box cartridge 110. The gasket 166 may be deformed as the lid 164 is engaged with the body 112 so as to create a seal.

In embodiments a desiccant may be provided inside of the dry box embodiment 110 of the cartridge 102 so as to reduce the humidity therein.

Figure 4A:
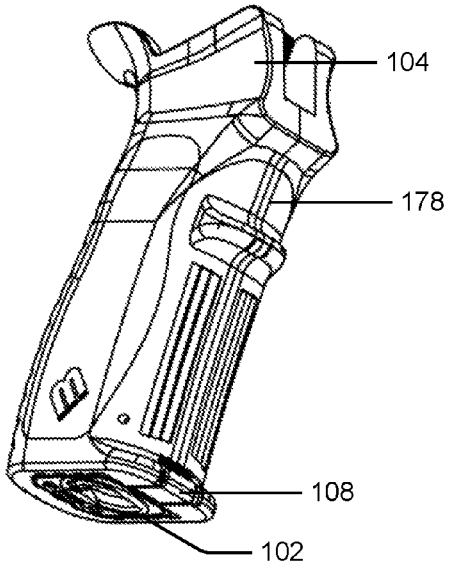
FIGS. 4A and B depict the same views as shown in FIGS. 3A and 3B, wherein the modular cartridge being depicted is an embodiment of a flashlight modular cartridge.
Figure 4B:
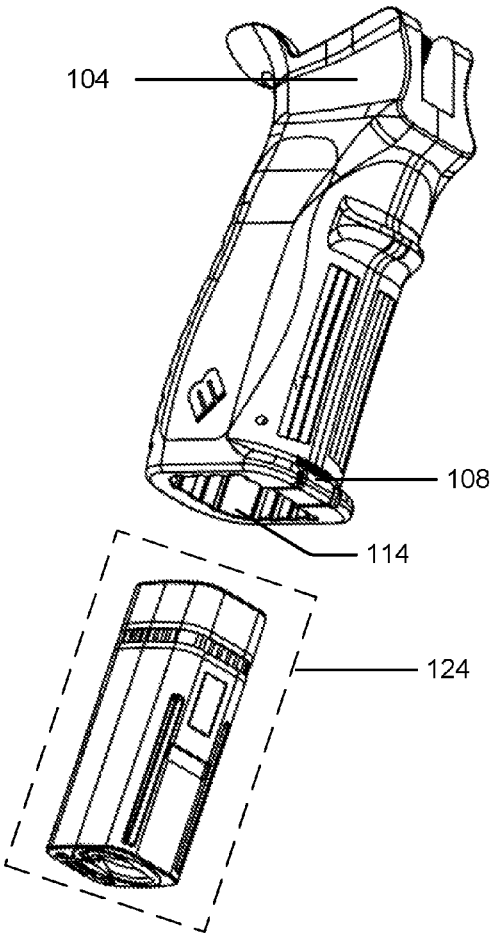
Figure 5:
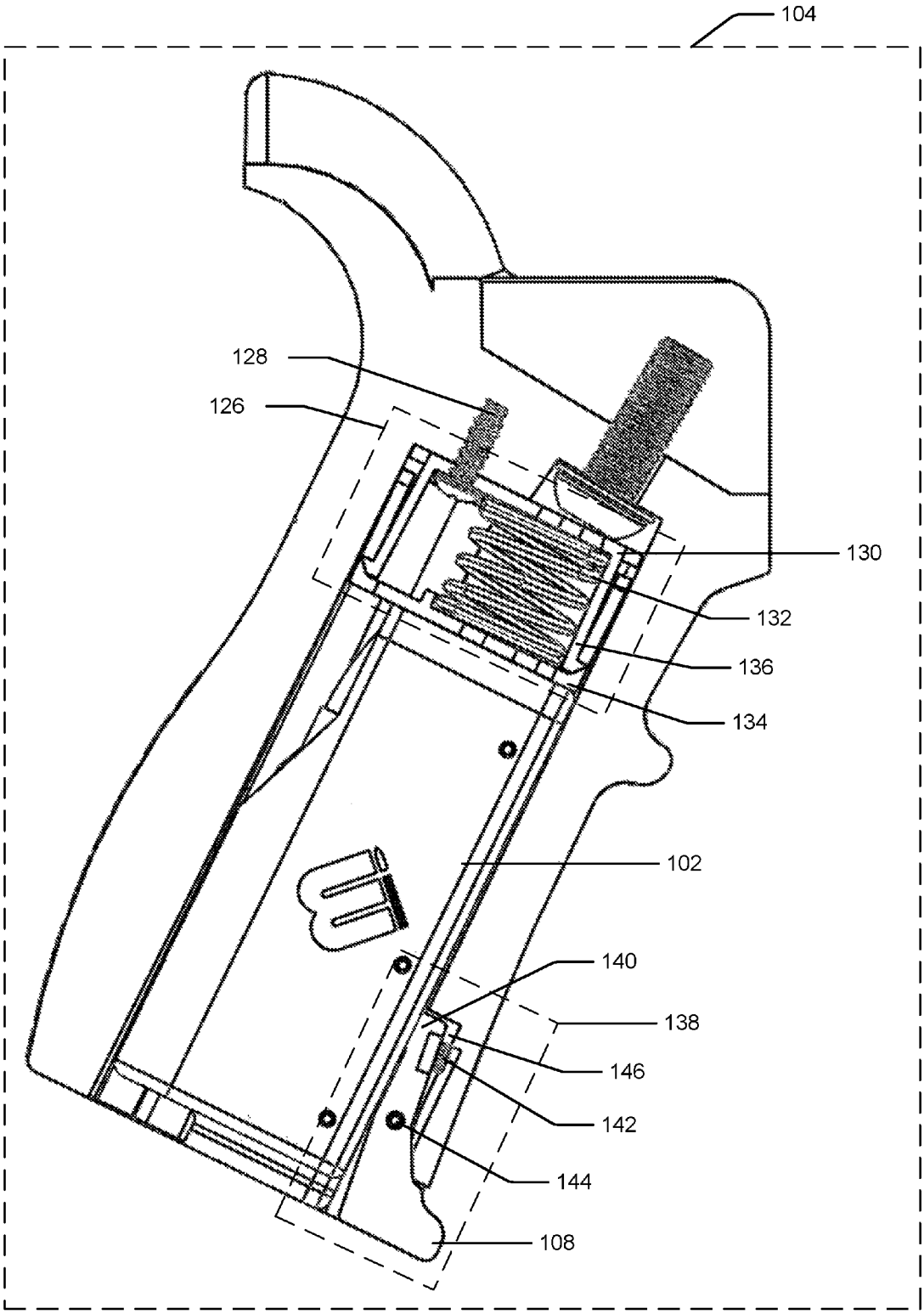
FIG. 5 depicts a partial cross-sectional view of a modular cartridge retaining system inside of a pistol grip, the modular cartridge retaining system having a modular cartridge retained therein.

In embodiments the cartridge may provide a flashlight, see FIGS. 4A and B.

In embodiments the cartridge may provide for a battery charger. In such embodiments there may be a usb or other power output connection integrated into the cartridge so that a power storage component inside of the battery charger embodiment of the cartridge may be electrically connected to an electronic device such that the electronic device may receive electrical power therefrom.

FIGS. 14A-I show multiple perspectives of an alternate embodiment of the monopod cartridge 168 which may be configured for use with a generic A2 style grip or other suitable cavity 114 in a firearm 100 which does not possess the modular cartridge retaining system 104 (i.e. has a cavity 114 with an interior volume 114, but may not possess the ejection mechanism 126, the biasing lever 138, etc.). In such embodiments, the cartridge 102 may not comprise a depression 116, and may instead comprise a friction lock 172 and a control knob 170 for the friction lock 172. The friction lock 172 may be a movable piece that extends out of a lateral side of the alternative embodiment of the monopod cartridge 168. The friction lock 172 may be extended or retracted through rotation of the control knob 170. Once inserted into the A2 style grip the control knob 170 may be rotated in a first direction, thereby extending the friction lock 172 outwards from the external lateral side of the alternate embodiment of the monopod cartridge 168 until the friction lock 172 mechanically engages with the opposing interior lateral side of the cavity 114 in a friction fit with sufficient force to mechanically interfere with the egress of the alternate embodiment of the monopod cartridge 168 from the interior volume 114 of the cavity 114, It will be understood that the friction lock 172 may be extended for the cartridge to be mechanically engaged in a friction fit with the lateral wall in cavities of different widths, where the space between the cartridge exterior and lateral walls of the cavity can be bridged by extending the friction lock 172. To remove the alternate embodiment of the monopod cartridge 168 from the generic A2 style grip, the control knob 170 may be rotated in a second direction (opposite the first direction) to cause the friction lock 172 to be retracted until it no longer mechanically interferes with the egress of the alternate embodiment of the monopod cartridge 168 from the interior volume 114 of the cavity 114. The control knob 170 may extend beyond the bottom opening of the cavity 114 so that it may be accessed by the operator while the alternate embodiment of the monopod cartridge 168 is fully inserted into the interior volume 114 of the cavity 114.

Further, although exemplary devices and figures to implement the elements of the disclosed subject matter have been provided, one skilled in the art, using this disclosure, could develop additional hardware to practice the disclosed subject matter and each is intended to be included herein. In addition to the above described embodiments, those skilled in the art will appreciate that this disclosure has application in a variety of arts and situations and this disclosure is intended to include the same.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

What is claimed is:

1. A modular cartridge retaining system for a firearm, the system comprising:

a cavity defined within a pistol grip of a firearm, the cavity having a top surface, a plurality of lateral surfaces, and an opening, the opening positioned at a bottom portion of the pistol grip, said cavity defining an interior volume, at least one of the plurality of lateral surfaces having a recessed portion;

a biasing lever having a major portion retained within the recessed portion of the lateral surface, the biasing lever pivotably connected to the recessed portion of the lateral surface, the biasing lever pivotable between a default engaged position in which an engaging end of the biasing lever projects out of the recessed portion of the lateral surface and extends into the interior volume and a disengaged position in which the engaging end of the biasing lever is seated within the recessed portion, and wherein the pivoting of the biasing lever between the default engaged position and the disengaged position may be effectuated through the actuation of a release, the release extending outside of the interior volume at a position at the bottom portion of the pistol grip without extending beyond a bottom surface of the pistol grip;

an ejection mechanism comprising:

an anchor plate having a top surface abutting and mechanically securable to the top surface of the cavity;

an ejection sled disposed within the interior volume, beneath the anchor plate;

an ejection spring, the ejection spring positioned with a first end engaging a bottom surface of the anchor plate and a second end engaging a top surface of the ejection sled;

an ejection sled connector extending from a bottom surface of the anchor plate to a portion of the ejection sled, wherein the ejection sled connector prevents parting of the ejection sled from the anchor plate due to a force exerted by the ejection spring, and wherein the ejection sled may translate relative to the anchor plate from a first position in which the ejection spring is in a less compressed state to a second position in which the ejection spring is in a more compressed state.

2. A modular cartridge kit for a firearm, the kit comprising:

a modular cartridge retaining system for a firearm, the system comprising:

a cavity defined within a pistol grip of a firearm, the cavity having a top surface, a plurality of lateral surfaces, and an opening, the opening positioned at a bottom portion of the pistol grip, said cavity defining an interior volume, at least one of the plurality of lateral surfaces having a recessed portion;

a biasing lever having a major portion retained within the recessed portion of the lateral surface, the biasing lever pivotably connected to the recessed portion of the lateral surface, the biasing lever pivotable between a default engaged position in which an engaging end of the biasing lever projects out of the recessed portion of the lateral surface and extends into the interior volume and a disengaged position in which the engaging end of the biasing lever is seated within the recessed portion, and wherein the pivoting of the biasing lever between the default engaged position and the disengaged position may be effectuated through the actuation of a release, the release extending outside of the interior volume at a position on the bottom portion of the pistol grip without extending beyond a bottom surface of the pistol grip;

an ejection mechanism comprising:

an anchor plate having a top surface abutting and mechanically securable to the top surface of the cavity;

an ejection sled disposed within the interior volume, beneath the anchor plate;

an ejection spring, the ejection spring positioned with a first end engaging a bottom surface of the anchor plate and a second end engaging a top surface of the ejection sled;

an ejection sled connector extending from a bottom surface of the anchor plate to a portion of the ejection sled, wherein the ejection sled connector prevents parting of the ejection sled from the anchor plate due to a force exerted by the ejection spring, and wherein the ejection sled may translate relative to the anchor plate from a first position in which the ejection spring is in a less compressed state to a second position in which the ejection spring is in a more compressed state; and a cartridge for a firearm, the cartridge comprising:

a cartridge top surface, a cartridge bottom surface, and a plurality of cartridge lateral surfaces, at least one of the plurality of cartridge lateral surfaces having a depression extending a portion of the width of the cartridge lateral surface, the depression comprising a bevel, a floor, and a stop, wherein the bevel transitions the cartridge lateral surface to the floor of the depression forming a first angle therebetween and the stop transitions the cartridge lateral surface to the floor of the depression forming a second angle therebetween, wherein the stop is located nearer the cartridge top surface than the bevel.

3. The kit of claim 2, wherein the cavity is formed inside of a grip portion of a firearm.

4. The kit of claim 2, wherein the bevel of the cartridge is situated so as to be aligned with the engaging end of the biasing lever when the cartridge is fully inserted into the interior volume of the cavity.

5. The kit of claim 2, wherein the force exerted by the ejection spring urges the stop against the engaging end of the biasing lever to fix the cartridge in place within the cavity when the cartridge is fully retained within the interior volume.

* * * * *